United States Patent [19]

Otake

[11] Patent Number: 4,958,748

[45] Date of Patent: Sep. 25, 1990

[54] ADHESIVE CONTAINER/FEEDER

[75] Inventor: Masaaki Otake, Ohmiya, Japan

[73] Assignee: Sekisui-Iko Co., Ltd., Tokyo, Japan

[21] Appl. No.: 376,736

[22] Filed: Jul. 7, 1989

[51] Int. Cl.[5] ..... B65D 37/00

[52] U.S. Cl. ..... 222/131; 222/183; 222/214; 222/420; 401/158; 401/161

[58] Field of Search ..... 222/108, 214, 206, 215, 222/325, 494, 131, 173, 183, 420; 401/156, 158, 161, 160, 162

[56] References Cited

U.S. PATENT DOCUMENTS

| | | | |
|---|---|---|---|
| 579,135 | 3/1897 | Cooper | 222/214 X |
| 1,007,619 | 5/1910 | Vogelmann | 401/158 |
| 1,775,400 | 9/1930 | Kramer | 222/215 X |
| 2,522,832 | 9/1950 | Loeffler | 222/215 X |
| 2,556,994 | 6/1951 | Candolini et al. | 222/214 |
| 2,582,391 | 1/1952 | Morris | 401/162 |
| 3,224,650 | 12/1965 | Willits, Jr. | 222/214 X |
| 3,366,284 | 1/1968 | Marona | 222/420 X |
| 4,498,609 | 2/1985 | Stock | 222/420 |

FOREIGN PATENT DOCUMENTS

| | | | |
|---|---|---|---|
| 578465 | 9/1924 | France | 401/162 |
| 918085 | 6/1951 | France | 401/160 |
| 2181105 | 4/1987 | United Kingdom | 222/214 |

*Primary Examiner*—Andres Kashnikow
*Assistant Examiner*—Gregory L. Huson
*Attorney, Agent, or Firm*—Jordan and Hamburg

[57] ABSTRACT

An adhesive container/feeder comprises an elastic container filled with a liquid adhesive, opposite side push members coupled to each other by a connector spring to bias the members away from each other, and a case accommodating the container such that an outlet nozzle of the container projects from the upper end and having opposite side operation windows formed in the peripheral wall of the case. The members which are coupled to each other and biased away from each other and are disposed to project out of and retreat into the respective windows. A sealing cap is removably fitted on the lower end of the case for holding the bottom of the liquid adhesive container, and a top cap is removably fitted on said case to cover the outlet nozzle of the liquid adhesive container and an upper end portion of the case. The liquid adhesive can be provided as a drop to a part to be bonded without contacting such part.

14 Claims, 4 Drawing Sheets

ADHESIVE CONTAINER/FEEDER

BACKGROUND OF THE INVENTION

1. FIELD OF THE INVENTION

This invention relates to an adhesive container/feeder for containing a liquid adhesive, particularly cyanoacrylate liquid adhesive, and feeding such adhesive to a portion of an object that is to be bonded.

2. DESCRIPTION OF THE PRIOR ART

When a usual adhesive container with a contain cap is out of use, it is accommodated in a separate case on which an case cap is then fitted and is stored in this state. In use, the adhesive container is taken out from the case by removing the case cap, then the container cap is removed, and then a required amount of adhesive is discharged from an outlet of the container by squeezing the container. This procedure of use is rather cumbersome. In addition, when taking out or accommodating the container from or in the case or when removing or fitting again the container cap or when squeezing the container, the hands and fingers touch the container and container cap, so that it is liable that adhesive leaking out from the outlet attaches inself and contaminates the hands and fingers. Once the adhesive is attached to the hands or fingers, it is difficult to remove and sometimes causes dermatitis.

Further, with a prior art pen type liquid adhesive container, the adhesive container will not come out unless the container is urged against a portion of an object to be bonded. Therefore, an excess of liquid adhesive is liable to be discharged and to be attached to various other parts than the area to be bonded, thus resulting in the troubles noted above.

SUMMARY OF THE INVENTION

The primary object of the invention is to provide an adhesive container/feeder, which can be simply handled for use and storage.

Another object of the invention is to provied a safe and clean adhesive container/feeder, which is free from the possibility of clinging to the hands and fingers with adhesive when it is used or when it is stored after use.

A further object of the invention is to provide an adhesive container/feeder, which is capable of discharging adhesive with its adhesive container accommodated in its case.

A still further object of the invention is to provide a pippet-type adhesive container/feeder, which can supply adhesive to a desired part without contact therewith.

A yet further object of the invention is to provide an adhesive container/feeder, with which liquid adhesive can be discharged from an outlet without touching the adhesive container but by merely pushing left and right push members restorably projecting from the outer periphery of the case toward each other.

A yet further object of the invention is to provide an adhesive container/feeder, which can permit excess adhesive discharged from the outlet to be withdrawn again into it at the outlet by releasing the left and righ push members To attain the above objects of the invention, there is provided an adhesive container/feeder, comprising an elastic adhesive container containing a liquid adhesive, opposite side push members coupled to each other by connector means serving as spring means to bias the members away from each other, a case accommodating said container such that an outlet nozzle of said container projects from the upper end and having opposite side operation windows formed in the peripheral wall, said push members being coupled to each other and biased away from each other and being disposed for projection out of and retreating into said respective windows, a sealing cap removably fitted in the lower end of said case of holding the bottom of said liquid adhesive container and a top cap removably fitted on said case to cover said outlet nozzle of said liquid adhesive container and an upper end portion of said case.

DESCRIPTION OF THE PREFERRED EMBODIMENT

Figure 1:
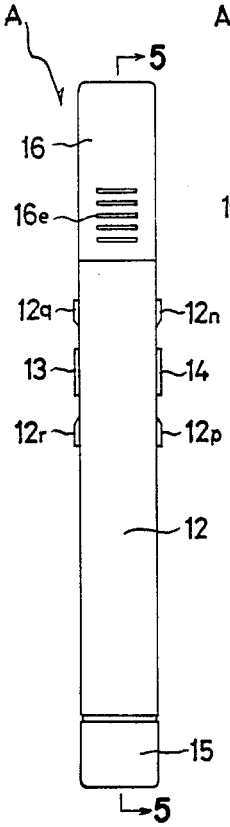
FIGS. 1 to 4 are respectively a front view, a right side view, a plan view and a bottom view showing an embodiment of the liquid adhesive container/feeder according to the invention.
Figure 2:
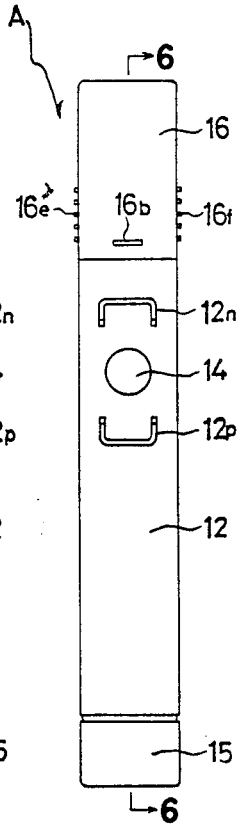

An embodiment of the invention will now be described with reference to the drawings.

The adhesive container/feeder according to the invention, as labeled A in FIGS. 1 to 6, comprises a liquid adhesive container 11, a case 12, opposite side push members 13 and 14, a sealing cap 15 and a top cap 16.

Figure 5:
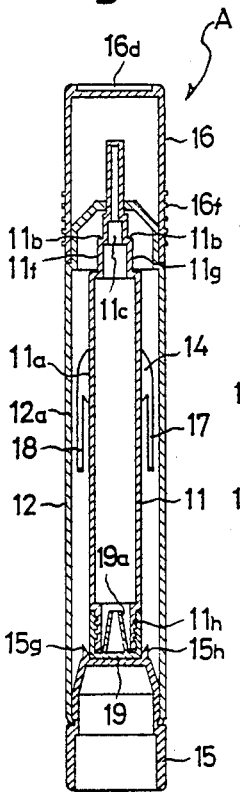
FIGS. 5 and 6 are respectively sectional views taken along line 5—5 in FIG. 1 and line 6—6 in FIG. 2.
Figure 6:
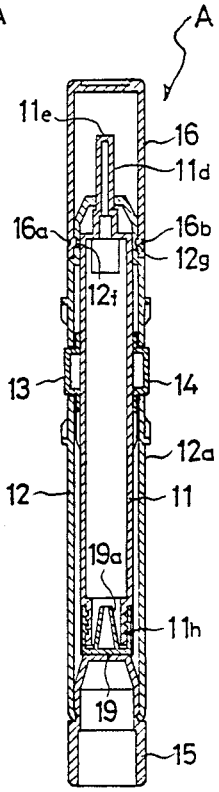
Figure 3:
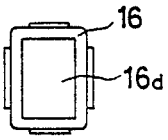
Figure 4:
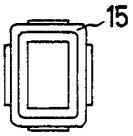
Figure 7:
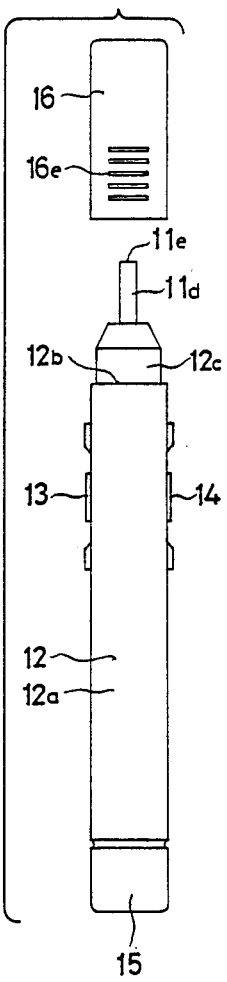
FIGS. 7 and 8 are respectively a front view, and a right side view showing the embodiment with a top cap removed.
Figure 10:
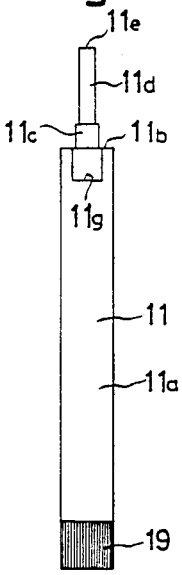
FIG. 10 is a right side view showing a liquid adhesive container used in the embodiment of the invention.
Figure 11:
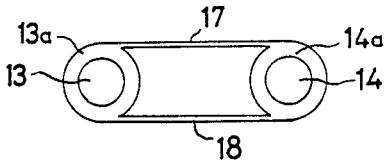
FIGS. 11 and 12 are respectively a developed plan view and a front view showing a twin push member used in the embodiment of the invention.
Figure 12:
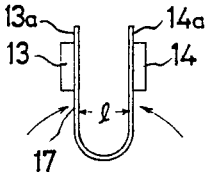
Figure 13:
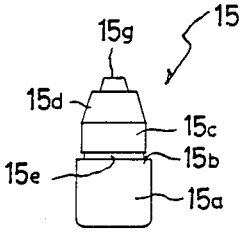
FIGS. 13 to 15 are respectively a front view, a plan view and a right side view showing a sealing cap used in the embodiment of the invention.
Figure 15:
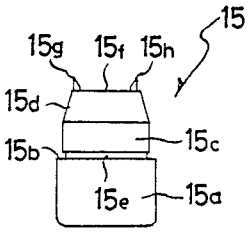
Figure 14:
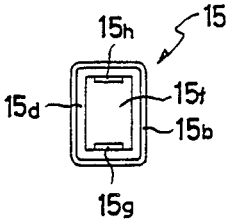

As shown in FIGS. 5, 6 and 10, the liquid adhesive container 11, which is made of polyethylene or like soft elastic material and filled with a liquid adhesive, has a cylindrical body portion **11*a*, a shoulder 11*b* at the upper end of the body portion 11*a*, a neck 11*c* extending upwardly from the shoulder 11*b* and a tubular outlet nozzle 11*d* extending upwardly from the neck 11*c*. It has diametrically opposite recessed portions 11*f* and 11*g* adjacent to the shoulder 11*b*. Its lower end constitutes an inlet 11*h*, which is sealed with a screw cap 19 having a tapering inner plug 19*a*. The outlet nozzle 11*d* has a sealed free end 11*e***, which can be unsealed using a needle or a tip of a scissors.

As shown in FIGS. 5 to 9, the case 12, which is made of a plastic material such as polyethylene or polypropyrene, has an elongate hollow cylindrical body portion **12*a* closed at the top and opened at the bottom. It has a shoulder 12*b*, an corner neck 12*c* extending upwardly from the shoulder 12*b*, and an angular tapered top 12*e* extending upwardly from the corner neck 12*c* and formed at the center with an outlet nozzle insertion hole 12***d*. The corner neck 12*c* has a pair of horizontal engagement recesses 12*f* and 12*g* formed in central portions of the opposite side outer surfaces. The open lower end 12*b* of the case 12 has a slight inward projection 12*j* formed around the edge. The body portion 12*a* has an upper portion formed with diametrically opposite circular operation windows 12*k* and 12*m*. Further, it has a pair of channel-shaped guard ridges 12*n* and 12i p formed above and below the window 12*k* such as to face each other and also another pair of channel-shaped guard ridges 12*q* and 12*r* formed above and below the window 12*m* such as to face each other. When the liquid adhesive container 11 is accommodated in the case 12, its outlet nozzle 11*d* projects outwardly from the outlet nozzle insertion hole 12*d* formed at the top of the angular tapered top 12i e.

It is possible to provide a continuous guard ridge instead of the pair of guard ridges 12*n* and 12*p*, and also instead of the pair of guard ridges 12*q* and 12*r*.

As shown in FIGS. 6, 7, 11 and 12, opposite side push members 13 and 14 are made of an elastic plastic material such as vinyl or nylon. Their edges 13*a* and 14*a* are connected to each other by a pair of parallel soft cord typed springs 17 and 18. The push members 13 and 14 and the parallel soft cord typed springs 17 and 18 constitute an integral twin push member. The twin push member is inserted with the central portions of the parallel soft cord typed springs 17 and 18 bent in the directions of the arrows in FIG. 12 into a U-shaped form into the case 12 from the lower open end 12*h*, and the push members 13 and 14 are engaged in the respective circular operation windows 12*k* and 12*m* for projection and retreat with respect to these windows. In this state, the push members 13 and 14 are biased away from each other while they are spaced apart by a sufficient distance l to permit insertion of the liquid adhesive container 11. Thus, as shown in FIGS. 5 and 6, when the container 11 is inserted in the case 12 so that its body portion 11*a* is disposed between the parallel soft cord typed springs 17 and 18 and also between the edges 13*a* and 14*a* of the push members 13 and 14, the tendency of the push members 13 and 14 to project from the operation windows 12*k* and 12*m* is backed up.

As shown in FIGS. 5, 6 and 13 to 15, the sealing cap 15, which is made of the same material as the case 12, is in the form of a hollow cylinder closed at the top and opened at the bottom. It has a lower portion 15*a* having a large thickness a shoulder 15*b* at the upper end of the lower portion 15*a* and angular reduced-thickness portion 15*c* united to the shoulder 15*b*. The corner reduced-thickness portion 15*c* can be fitted in the case 12 from the lower end thereof, and it has an corner tapered upper half portion 15*d*. Also, its stem is formed over the entire circumference with a groove 15*e*, which can receive the inward projection 12*j* formed around the lower open end 12*h* of the case 12. The top 15*f* of the sealing cap 15 is formed with a pair of opposite side parallel and elongate holding ridges 15*g* and 15*h* having a right-triangular sectional profile for engaging with the opposite sides of the liquid adhesive container 15 adjacent to the bottom thereof when the sealing cap 15 is fitted in the case 12 from the lower end thereof.

Figure 8:
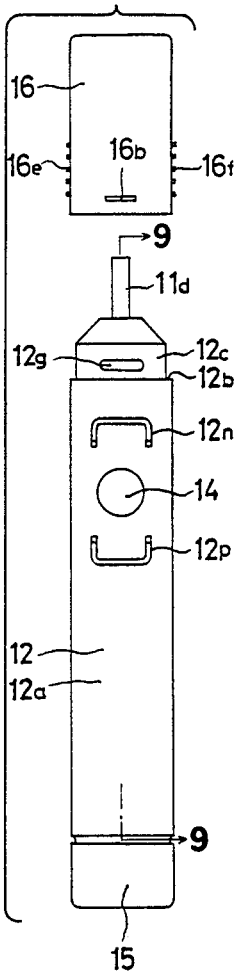
Figure 9:
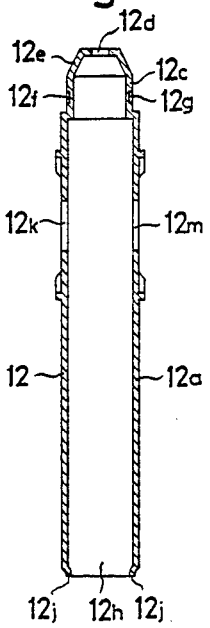
FIG. 9 is a sectional view taken along line 9—9 in FIG. 8 showing a case used in the embodiment of the invention.
Figure 16:
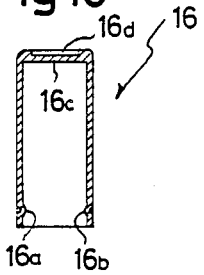
FIG. 16 is an axial sectional view showing the top cap in the embodiment.

As shown in FIGS. 5, 8 and 16, the top cap 16, which is made of the same material as the case 12, has horizontal ridges 16*a* and 16*b* formed in central portions of the opposite side inner surfaces adjacent to the lower end. The ridges 16*a* and 16*b* can be fitted in the horizontal engagement receses 12*f* and 12*g* of the case 12. The top cap 16 also has a top 16*c* with a recess 16*d* formed in the top surface. Further, it has a number of anti-slip projections 16*e* and 16*f* formed on the opposite outer surfaces.

The liquid adhesive container/feeder A having the construction as described according to the invention is used by removing the top cap 16. To remove the top cap 16, the case 12 is held clamped with the thumb $\beta'$ and index finger $\gamma'$ of one hand, while the anti-slip projections 16*e* and 16*f* of the top cap 16 are held urged with the thumb $\beta$ and index finger $\gamma$ of the other hand 21, whereby the engagement of the ridges 16*a* and 16*b* of the top cap 16 in the recesses 12*f* and 12*g* of the case 12 is loosened. In this state, the top cap 16 is pulled upwardly, whereby the top cap 16 can be readily removed from the top of the case 12.

Figure 17:
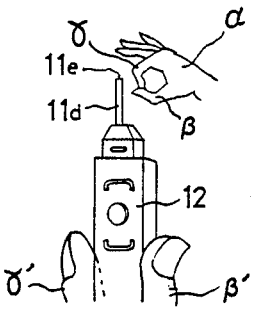
Figure 18:
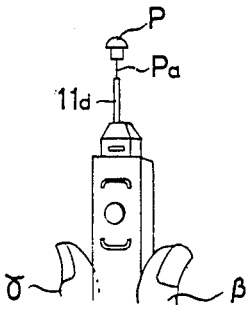

Then, if the container/feeder is used for the first time, the sealed free end 11*e* of the outlet nozzle 11*d* is unsealed. To this end, the outlet nozzle 11*b* is topped with the index finger $\gamma$ with the free end 11*c* directed up as shown in FIG. 17, and the tip Pa of a separately provided pin P is inserted into the free end 11*e* of the outlet nozzle 11*d* while taking care that the push members 13 and 14 will not be pushed as shown is FIGl. 18, thus forming a through hole in the unsealed free end 11*e*.

Figure 20:
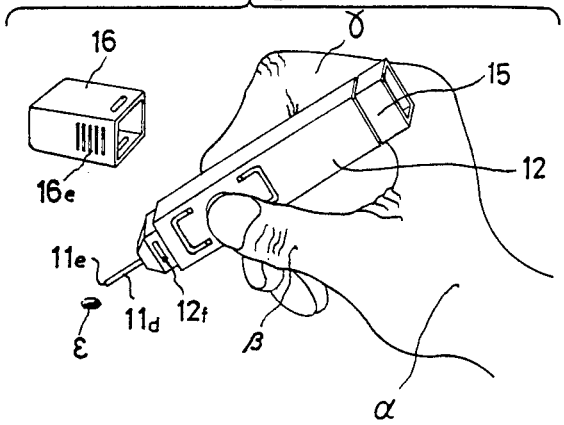
FIGS. 17 to 21 are views for explaining the procedures of unsealing, use and storage of the adhesive container/feeder according to the invention.
Figure 19:
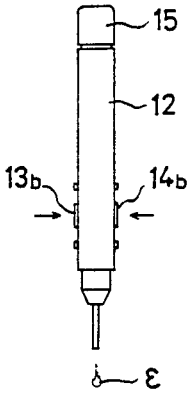
Figure 21:
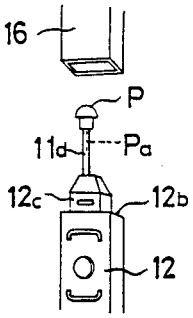

Then, as shown in FIGS. 19 and 20, the case 12 is held with the hand, and with the free end 11*e* of the outlet nozzle 11*d* held at a part in the vicinity of a portion to be bonded, the push members 13 and 14 projecting from the circular operation windows 12*k* and 12*m* are pushed toward each other with the thumb and index finger of the hand holding the case 12. As a result, the push members 13 and 14 are retreated into the operation windows 12*k* and 12*m* against the elastic biasing force of the parallel cord springs 17 and 18 bent in the U-shaped form, thus pushing the opposite sides of the body portion 11*a* of the liquid adhesive container 11 that is located between the push members 13 and 14. The liquid adhesive contained in the container 11 thus is discharged through the outlet nozzle 11*d* and from the free end 11*e* to be supplied as a drop $\epsilon$ to the part to be bended.

At any time, a subtle control of the amount of liquid adhesive discharged can be obtained by controlling the force with which the push members 13 and 14 are pushed.

When the supply of the liquid adhesive is completed, the push members 13 and 14 are released, whereby the excess liquid adhesive led through the outlet nozzle 11*d* and collected at the free end 11*e* is withdrawn into the body portion 11*a* of the container 11 again. It is thus possible to eliminate the leakage of liquid adgesive after the completion of the supply and attachment of leaking liquid adhesive to the outlet nozzle 11*d* and free end 11*e*.

To store the liquid adhesive container/feeder A after use, the hole of the freen end 11*e* of the outlet nozzle 11*d* is closed by inserting the tip pa of the pin P into the hole, and then the top cap 16 is placed on the case 12 and pushed along the corner neck 12*c* until its lower end strikes the shoulder 12*b*. As a result, the ridges 16*a* and 16*b* of the top cap 16 are received in the recesses 12*f* and 12*g* of the case 12, so that the top cap 16 is held on the top portion of the case 12. In this state, the liquid adgesive container/feeder A can be stored.

For replacing the liquid adhesive container/feeder 11 with a new one after it becomes empty, the engagement between the inward projection 12*j* at the lower open end 12*h* of the case 12 in the groove 15*e* of the sealing cap 15 is released, and then the empty container 11 is taken out by pulling out the corner reduced-thickness portion 15c from the lower open end 12h of the case 12.

While in the above embodiment of the invention the push members and operation windows are circular in shape, this shape is by no means limitative, and it is possible to adapt any other shape as rectangular, parallologramic, square and polygonal shapes.

As has been described in the foregoing, with the liquid adhesive container/feeder according to the invention a desired amount of liquid adhesive can be discharged from the free end of the outlet nozzle without the need of taking the liquid adhesive container out of its case, but by merely pushing the push members toward each other after removing the top cap. It is thus possible to simplify the operation of applying the liquid adhesive. In addition, the liquid adhesive container and outlet nozzle are never touched from the start of preparation of the coating operation till the completion of storage of the liquid adhesive container/feeder. Further, the excess liquid adhesive that remains around the free end of the outlet nozzle after completion of the liquid adhesive application is withdrawn into the container with the releasing of the push members. Thus, there is no possibility of attachment of excess liquid adhesive to the outlet nozzle free end, which is thus clean at all times, and also there is no possibility of contamination of the hands, fingers or cloth with liquid adhesive. The liquid adhesive container /feeder accoring to the invention thus can be used safely and easily.

Further, although the liquid adhesive container/-feeder according to the invention resembles the prior art pen-type liquid adhesive containner, in the pen type no liquid adhesive will come out unless the containre is urged against a part to be bonded, so that it is difficult to control the amount of liquid adhesive discharged. In addition, liquid adhesive which is discharged or going to be discharged can not be returned into the body portion of the container, so that attachment of liquid adhesive to the neighborhood of the free end of the outlet nozzle can not be avoided. Unlike this pen type liquid adhesive container, the liquid adhesive container/feeder according to the invention is of a pippet type and permits discharge of liquid adhesive drop by drop by pushing the members with the thumb and index finger. Thus, the liquid adhesive container/ feeder according to the invention can be used for supplying liquid adhesive even to a locality at a depth, a place having irregular surface configurations, a material which is so fragile that no force can be applied or a material high in elasticity.

Furthermore, since the opposite side operation windows formed in the peripheral wall of the case are surrounded by the guard ridges, it is possible to avoid the possibility of discharge of liquid adhesive from the outlet nozzle free end with occasional pushing of the push members in such case as when the liquid adhesive container/feeder according to the invention is put on a desk with either side down. The invention is thus very beneficial and useful in practice.

What is claimed is:

1. An adhesive applicator device comprising an elastic container filled with liquid adhesive, said container having an outlet nozzle, a case accommodating said container such that said outlet nozzle projects from said case, said case having a pair of diametrically opposed window openings, push button means comprising opposed push button projections extending into said window openings, said push button means further comprising biasing means connected to and extending from said push button projections for biasing said push button projections outwardly into said window openings, whereby said liquid adhesive is discharged from said outlet nozzle one drop at a time by manually pushing said opposed push button projections from an initial position to a displaced position against the bias of said biasing means, said push button projections being returned to said initial position by said biasing means when said manual pushing is discontinued.

2. An adhesive applicator device comprising an elastic container containing a liquid adhesive, said container having an outlet nozzle, a case accommodating said container such that said outlet nozzle projects from said case, said case having a pair of diametrically opposed window openings, push button means comprising opposed push button projections extending into said window openings, said push button means further comprising biasing means extending from said push button projections for biasing said push button projections outwardly into said window openings, said biasing means being disposed on opposite sides of said container and being joined to said push button projections such that said push button means thereby encircles said container, whereby said liquid adhesive is discharged from said outlet nozzle by manually pushing said opposed push button projections from an initial position to a displaced position against the bias of said biasing means, said push button projections being returned to said initial position by said biasing means when said manual pushing is discontinued.

3. A cyanoacrylate liquid adhesive container/feeder comprising an elastic container made of polyethylene plastic resin and filled with a cyanoacrylate liquid adhesive, said container having an outlet nozzle, a case accommodating said container such that said outlet nozzle projects from said case, a cap disposed on said case and covering said outlet nozzle of said container, said case having a pair of diametrically opposed window openings, push button means comprising opposed push button projections extending into said window openings, said push button means further comprising biasing means extending from said push button projections for biasing said push button projections outwardly into said window openings, whereby said liquid adhesive is discharged from said outlet nozzle one drop at a time by manually pushing said opposed push button projections from an initial position to a displaced position against the bias of said biasing means, said push button projections being returned to said initial position by said biasing means when said manual pushing is discontinued.

4. A cyanoacrylate liquid adhesive container/feeder according to claim 3, wherein said case has a front end and a rear end, said outlet nozzle being juxtaposed to said front end, said cap being disposed on said front end, and a sealing cap means removably disposed on said rear end of said case to engage and support said container.

5. A cyanoacrylate liquid adhesive container/feeder according to claim 3, wherein said diametrically opposed window openings are circular.

6. A cyanoacrylate liquid adhesive container/feeder according to claim 3, wherein said biasing means comprises a pair of parallel spring parts connecting said opposed push button projections, each of said spring parts having a generally U-shaped configuration.

7. A cyanoacrylate liquid adhesive container/feeder according to claim 6, wherein said pair of parallel spring parts are spaced from one another to define a space therebetween, said container extending through said space such that each of said spring parts are disposed on opposite sides of said container.

8. A cyanoacrylate liquid adhesive container/feeder according to claim 6, wherein said push button projections are disposed in generally parallel planes, said U-shaped spring parts being disposed in generally parallel planes which are perpendicular to the first said parallel planes.

9. A cyanoacrylate liquid adhesive container/feeder according to claim 6, wherein each of said U-shaped spring parts has spaced parallel leg portions with each leg portions having a first end and a second end, said first ends of each U-shaped spring part being joined by a base portion, one of said push button projections connecting said second end of one leg portion of one U-shaped spring part to the second end of one leg portion of the other U-shaped spring part, the other of said push button projections connecting the second end of the other leg portion of said one U-shaped spring part to the second end of the other leg portion of the other U-shaped spring part.

10. A cyanoacrylate liquid adhesive container/feeder according to claim 3, wherein said container has a first container side juxtaposed to a first case side, a second container side juxtaposed to a second case side, a third container side juxtaposed to a third case side and a fourth container side juxtaposed to a fourth case side, one of said U-shaped spring parts being disposed between said first container side and said first case side, the other of said U-shaped spring parts being disposed between said third container side and said third case side, one of said push button projections being disposed between said second container side and said second case side, the other of said push button projections being disposed between said fourth container side and said fourth case side.

11. A cyanoacrylate liquid adhesive container/feeder according to claim 10, wherein said first, second, third and fourth container sides are arranged in a generally rectangular configuration.

12. A cyanoacrylate liquid adhesive container/feeder according to claim 10, wherein said first, second, third and fourth case sides are arranged in a generally rectangular configuration.

13. A cyanoacrylate liquid adhesive container/feeder according to claim 10, wherein said window openings are in said second and fourth case sides.

14. A cyanoacrylate liquid adhesive container/feeder according to claim 10, wherein said first container side is spaced from said first case side a first distance, said second container side being spaced from said second case side a distance which is less than said first distance.

* * * * *